US005803227A

United States Patent [19]

Stein et al.

[11] Patent Number: 5,803,227

[45] Date of Patent: Sep. 8, 1998

[54] BILL STACKER

[75] Inventors: Matthew I. Stein, Truckee, Calif.; Robert A. Luciano, Reno, Nev.

[73] Assignee: International Game Technology, Reno, Nev.

[21] Appl. No.: 486,411

[22] Filed: Jun. 6, 1995

[51] Int. Cl.[6] ..... G07F 7/04; B65H 29/46

[52] U.S. Cl. ..... 194/206; 271/84; 271/220

[58] Field of Search ..... 271/89, 189, 191, 271/200, 314, 198, 199, 220; 194/206

[56] References Cited

U.S. PATENT DOCUMENTS

| | | | |
|---|---|---|---|
| 3,567,047 | 3/1971 | Clausen | 271/191 X |
| 3,917,260 | 11/1975 | Okkonan et al. | 271/181 |
| 4,285,511 | 8/1981 | Abe | 271/178 |
| 4,513,880 | 4/1985 | Mori et al. | 221/260 |
| 4,540,081 | 9/1985 | Mori et al. | 194/4 |
| 4,556,139 | 12/1985 | Akagawa et al. | 194/4 |
| 4,580,774 | 4/1986 | Yamaguchi et al. | 271/84 X |
| 4,625,870 | 12/1986 | Nao et al. | 209/534 |
| 4,678,072 | 7/1987 | Kobayashi et al. | 194/206 |
| 4,712,787 | 12/1987 | Princiotta, Sr. et al. | 271/84 X |
| 4,720,092 | 1/1988 | Juleff | 271/207 |
| 4,809,966 | 3/1989 | Kobayashi et al. | 271/181 |
| 4,874,931 | 10/1989 | Oka et al. | 235/379 |
| 4,880,096 | 11/1989 | Kobayashi et al. | 194/206 |
| 4,884,671 | 12/1989 | Gardellini | 194/207 |
| 4,887,808 | 12/1989 | Dekker et al. | 271/181 |
| 5,005,688 | 4/1991 | Yakimoto et al. | 194/206 |
| 5,092,445 | 3/1992 | Kosima | 194/206 |
| 5,163,672 | 11/1992 | Mennie | 271/187 |
| 5,167,411 | 12/1992 | Isobe | 271/273 |
| 5,192,066 | 3/1993 | Steinhilber | 271/198 X |
| 5,205,481 | 4/1993 | Dekker | 232/16 |
| 5,207,788 | 5/1993 | Gella et al. | 271/122 |
| 5,242,041 | 9/1993 | Isobe | 194/207 |
| 5,254,841 | 10/1993 | Watanabe et al. | 238/279 |
| 5,267,826 | 12/1993 | Peters | 414/789.9 |
| 5,310,173 | 5/1994 | Martinez | 271/198 |
| 5,465,956 | 11/1995 | Takemoto et al. | 271/198 X |

FOREIGN PATENT DOCUMENTS

| | | | |
|---|---|---|---|
| 470329 | 2/1992 | European Pat. Off. | 271/200 |
| 1280155 | 10/1968 | Germany | 271/191 |

*Primary Examiner*—Boris Milef
*Attorney, Agent, or Firm*—Beyer & Weaver, LLP

[57] ABSTRACT

An improved bill stacker is described that effectively rolls incoming bills onto the stack. In one aspect of the invention, the bill stacker includes a housing that encloses a stacking plate that is arranged to support a stack of bills. A gripper is typically provided to grab the leading edge of an incoming bill and a stack roller is arranged to travel longitudinally relative the stacking plate to "roll" a newly received bill onto a top end of the bill stack (if present) or the stacking plate when the first bill is being received. A variety of methods of stacking bills in a cash box using the concept of rolling an incoming bill onto the top of a stack are also described.

44 Claims, 7 Drawing Sheets

50
98
44
46
55
90
95
94
48
43
82
42
80
92
59
130
38
70
84
85
40
57

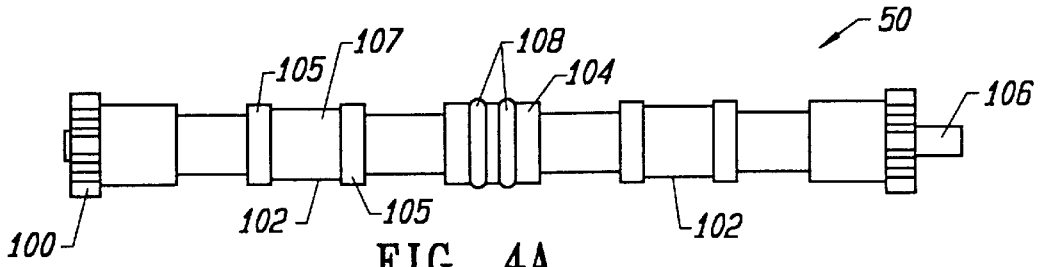
FIG. 4A
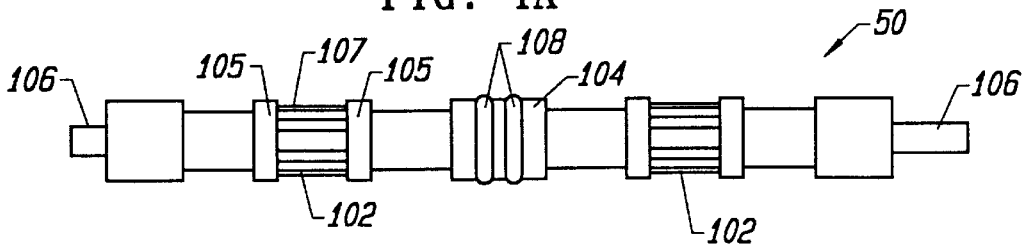
FIG. 4B
FIG. 5B
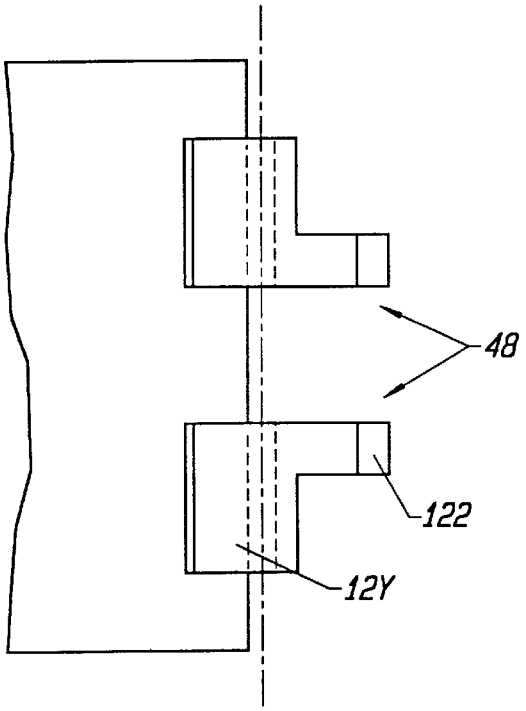
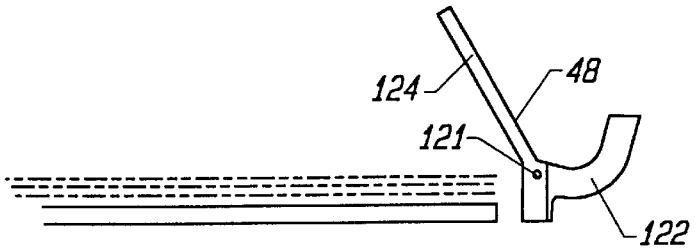
FIG. 5A

FIG. 10
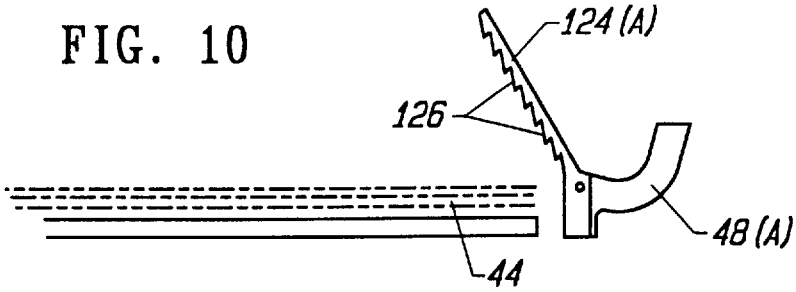
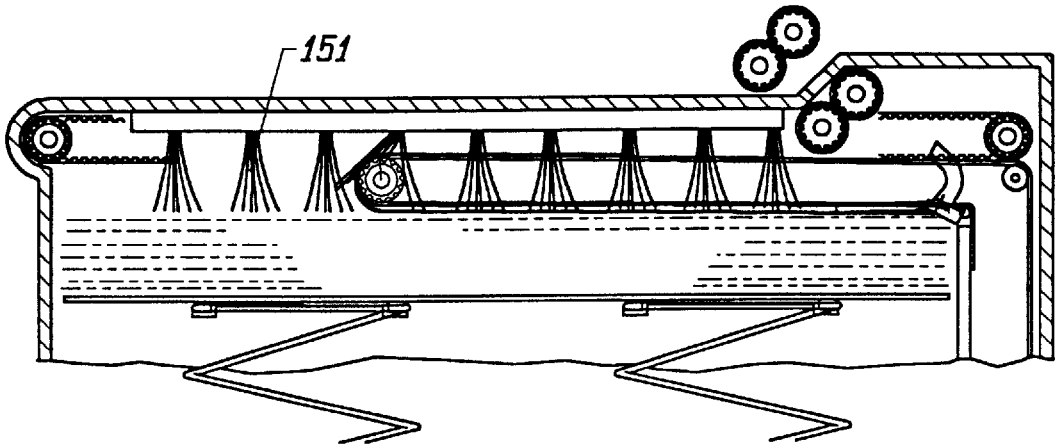
FIG. 11
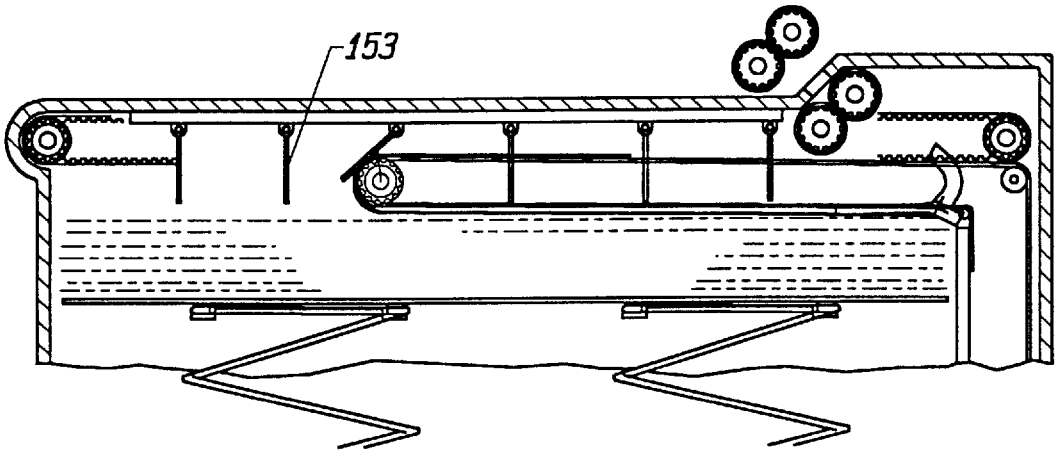
FIG. 12

BILL STACKER

FIELD OF THE INVENTION

The present invention relates generally to bill stackers. More particularly, a bill stacker that rolls out newly received bills as they are received is disclosed.

BACKGROUND OF THE INVENTION

There are a wide variety of mechanisms that are currently available for collecting paper currency. By way of example, one type of mechanism winds incoming bills onto a drum arrangement. Another type of mechanism essentially rams incoming bills into a bill receptacle without trying to arrange the bills in any order. Others contemplate stacking the incoming bills. As is well known to those skilled in the art, each of these types of mechanisms has its advantages and disadvantages. One of the most common type of bill stacking arrangements is designed to receive a bill into a stacking mechanism and then "ram" the bill onto a spring loaded stack that is aligned with the stacking mechanism. Although ram based stacking designs work well in many cases, they tend not to be very effective at handling bills of different sizes. Rather, they tend to work best when they handle bills having a common width.

Bill stackers have a wide variety of uses. By way of example, they are frequently used in bill acceptors and bill validator to organize the incoming bills. In most applications, the bill stack is arranged in a receptacle that may only be accessed by opening the bill acceptor itself. However, once the bill acceptor is opened, the person opening the bill acceptor has direct access to the bill stack. Although such an arrangement works well in applications where security is not a major issue, in certain industries, such as the gaming industry, security is a larger concern. More specifically, it is generally desirable that the bills be placed in a secure cash box that can not be accessed by maintenance people working on the bill acceptor or even the people that collect the cash boxes. The requirement of a secure cash box has limited the application of many bill stackers within the gaming industry since due to their inability to meet the industries strict security requirements.

As will be appreciated by those familiar with the gaming industry, bill acceptors have recently been added to a number of different gaming machines (such as slot machines, video poker machines etc.). The bill acceptors used in these machines typically have secure cash boxes that may not be accessed by maintenance personnel working on the gaming machines. One industry practice that has developed is the provision of two dedicated cash boxes for each bill acceptor. The cash boxes are locked such that they may not be readily opened by the person responsible for collecting the cash boxes, unless that person has a key. Typically, the keys to the cash box are not given to the person collecting the cash box, but rather, are given to authorized personnel in a dedicated counting center. Thus, when a first one of the cash boxes is collected, the second one of the cash boxes is available to be installed in its place and the first cash box is delivered to the counting center. In this manner, security is enhanced.

One drawback of currently available secure bill acceptors for the gaming industry is that they tend to constitute a significant portion of the production cost of many of the gaming machines that they are sold with. Accordingly, a more cost effective, secure bill acceptor that meets the need of the gaming industry would be highly desirable. One of the major components of secure bill acceptors is the cash box. This is particularly true in gaming applications where two dedicated cash boxes are often provided for each bill acceptor. Accordingly it would also be desirable to provide a more cost effective secure cash box construction as well.

SUMMARY OF THE INVENTION

To achieve the foregoing and other objects and in accordance with the purpose of the present invention, an improved bill stacker is described that effectively rolls incoming bills onto a stack. In one aspect of the invention, the bill stacker includes a housing that encloses a stacking plate that is arranged to support a stack of bills. A gripper is typically provided to grab the leading edge of an incoming bill and a stack roller is arranged to travel longitudinally relative the stacking plate to "roll" a newly received bill onto a top end of the bill stack (if present) or the stacking plate when the first bill is being received. A variety of methods of stacking bills in a cash box using the concept of rolling an incoming bill onto the top of a stack are also described.

In one embodiment, a stack positioning mechanism is provided to insure that the top surface of the bill stack remains in substantially the same plane regardless of the number of bills in the stack. With this arrangement, the stack roller is arranged to travel back and forth within a roller plane that is substantially parallel to the stacking plate. In one preferred arrangement, the positioning mechanism includes one or more springs that bias the stacking plate towards the roller plane and a stack stabilizing mechanism that positions the top surface of the bill stack by biasing the stack in the opposite direction.

In another embodiment, a belt is provided that loops over the stack roller. The belt is rolled out across a top surface of an incoming bill as the bill is rolled onto the stack. Thus, when the stack roller is in its extended position, the belt lies across the top surface of the newly received bill which has just become the top surface of the bill stack. With this arrangement, the belt helps prevent the stack roller from catching any of the bills in the bill stack when the stack roller is returned to a home position that is suitable for receiving a next new bill. In some embodiments a pair of spaced apart belts are provided on opposite sides of the longitudinal centerline of the stacking plate. This is particularly useful in systems adapted to receive bills of different sizes. In some embodiments, the belt (or at least one of the belts in a multiple belt system) may be a timing belt that meshes with a gear in the stack roller. The timing belt provides one mechanism for insuring that the stack roller does not slip as it passes back and forth across the bill stack. The timing belt could be replaced by other flexible timing devices such as a chain, timing cable, etc.

In yet another embodiment, a rack is mounted on the housing and the stack roller includes a pinion that engages the rack. The pinion may be arranged to have a pitch diameter that is the same as a diameter of a rolling surface of the stack roller. This is an alternative mechanism for insuring that the stack roller does not slip as is passes back and forth across the bill stack. In some embodiments, a pair of racks and a pair of pinions may be provided, with the pinions and their corresponding racks being located on opposite sides of the roller.

In still another embodiment, the roller drive train may include a drive shaft that extends outside of the housing for engaging an external driver and a drive belt that extends between the drive shaft and the stack roller for driving the stack roller.

As indicated above, in some preferred embodiments, a gripper is provided to hold a first end of a newly received bill in place as it is rolled out by the stack roller. In one embodiment, the gripper takes the form of a cam mechanism that is moveable between a release position and a hold position. The release position is free from the bill stack and permits the first end of the newly received bill to be positioned on top of the stack. In the hold position the gripper holds the first end of the newly received bill in place. The stack roller may be arranged to toggle the gripper between the release and hold positions. In embodiments which include the described bill holding belts, the belt may be used to hold the gripper in position when the stack roller is in the extended position. In other embodiments, a cam actuated gripper may be provided together with a latch to hold the gripper in position. In some embodiments, a rotating or linearly reciprocating element extends to support the bill stack in the bill feed area while the main grippers are lifted and the next bill is being fed into position for stacking.

The described bill stacker may be used in a variety of applications. One application is in the environment of a cash box for a bill acceptor. In embodiments that require cash box security, the housing may have only two significantly sized openings though which the stack can be accessed. The first is a bill inlet sized suitably for receiving a bill. The second is a locking door for permitting access to the bill stack. For increased security it may be desirable to provide a pair of facing intake rollers positioned adjacent the bill inlet for guiding the newly received bill towards the stack roller. Such intake rollers are positioned to help prevent a stacked bill from being retrieved through the bill inlet. When used as part of a bill acceptor, in addition to the cash box, the bill acceptor will typically include a bill validator and a feed mechanism. The bill validator is arranged to validate bills introduced to the bill acceptor. Then a feed mechanism transports bills accepted by the bill validator to the cash box for storage. Typically, the feed mechanism includes anti-theft devices to prevent unauthorized retrieval of credited bills from the cash box through the use of wires, strings, plastics strips or the like that are attached to the incoming bills. Preferably, such a bill acceptor only gives credit for a validated bill after the bill has been rolled onto the bill stack.

BRIEF DESCRIPTION OF THE DRAWINGS

The invention, together with further objects and advantages thereof, may best be understood by reference to the following description taken in conjunction with the accompanying drawings in which:

FIG. 4A is a diagrammatic front view of one embodiment of a stacking roller suitable for use in the cash box of FIG. 2.

FIG. 4B is a diagrammatic front view of a second embodiment of a stacking roller.

FIG. 5A is a diagrammatic top view of the grippers illustrated in the cash box of FIG. 2.

FIG. 5B is a diagrammatic side view of the grippers illustrated in FIG. 5A.

FIG. 10 is a diagrammatic side view of an alternative embodiment of a gripper.

FIG. 11 is a diagrammatic cross sectional side view of an upper portion of an alternative cash box illustrating a brush based stack stabilizing mechanism.

FIG. 12 is a diagrammatic cross sectional side view of an upper portion of an alternative cash box illustrating a toggle cam based stack stabilizing mechanism.

DESCRIPTION OF THE PREFERRED EMBODIMENTS

Figure 1:
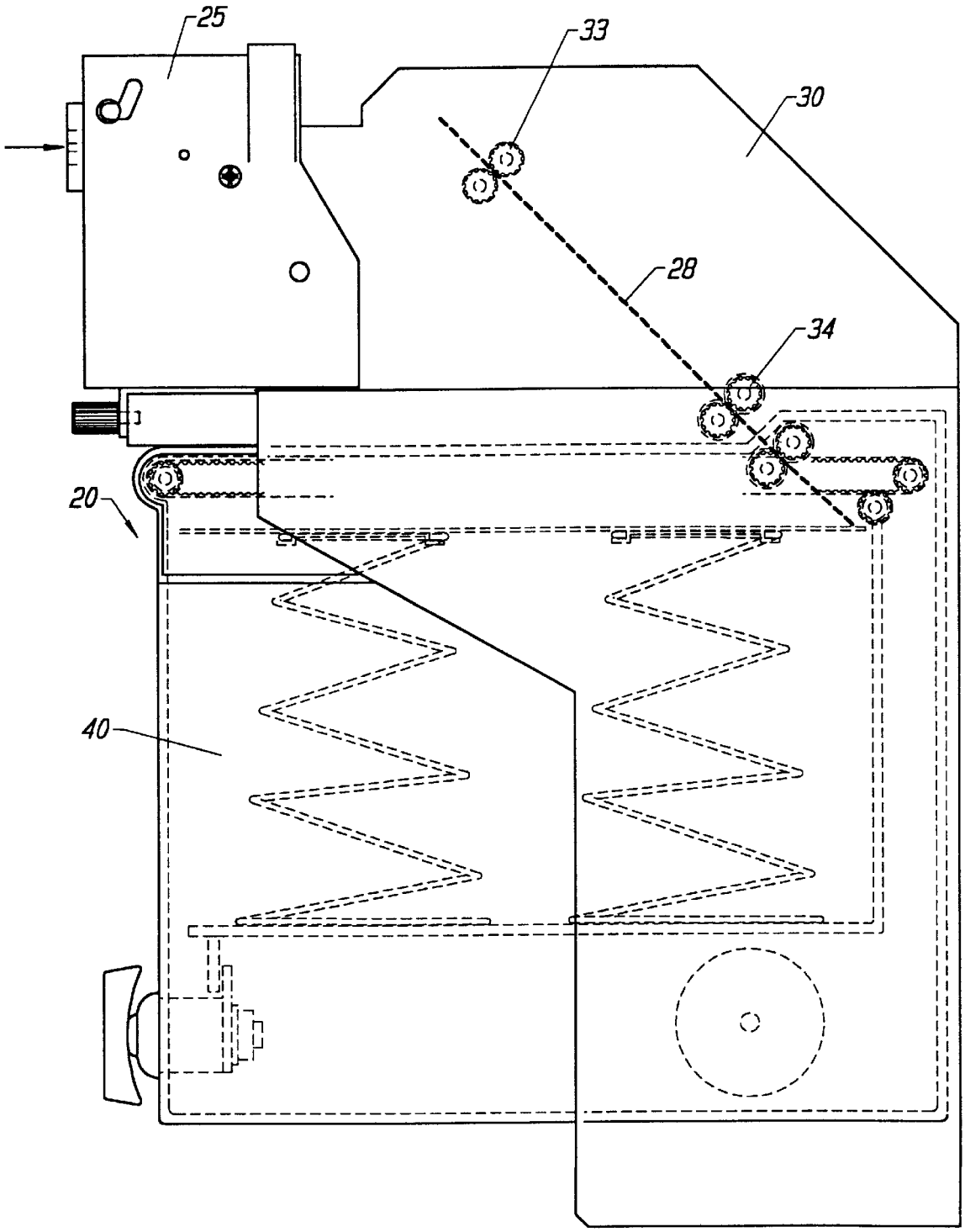
FIG. 1 is a schematic side view of a bill acceptor in accordance with one embodiment of the present invention.

The improved bill stacker of the present invention is arranged to effectively roll incoming bills onto a stack. In a preferred embodiment illustrated in the drawings, the leading edge of an incoming bill is gripped and held in place once it is received by the cash box. A stack roller is then used to roll the incoming bill onto a stack of bills.

One application for the described bill stackers is its use as a portion of an improved bill acceptor. By way of example, a representative bill acceptor is illustrated in FIG. 1. As seen therein, the bill acceptor 20 includes a bill validator 25, a feed mechanism 30 and a bill stacker 40. The bill validator 25 may take the form of almost any conventional bill validator head. The bill validator head has several functions that will vary somewhat in accordance with the requirements of the bill acceptor that it is made a part of. Typical functions include identifying the denomination of an incoming bill, validating the bill to make sure the bill in not counterfeit, and logging the bills received to facilitate an accounting trail. By way of example, bill validation heads are available, from a number of sources including Japan Cash Machine of Osaka, Japan.

The feed mechanism 30 is arranged to transport incoming validated bills 28 from the bill validator 25 to the bill stacker 40. Of course, the structure of the feed mechanism will vary to a great extent depending on the geometries of the bill validator 25, the bill stacker 40 and the footprint requirements of the bill acceptor. As described above, bill acceptors have a wide variety of applications. In some applications, such as in the gaming industry, it is highly desirable for the bill stacker 40 to take the form of a secure cash box. When the bill stacker is intended for use as a secure cash box, it is highly desirable that the housing have a limited number of openings which provide access to the bill stack. It is also desirable that such openings either be lockable or small enough such that is difficult to tamper with the device. In devices that require a secure cash box, it may be desirable for the feed mechanism 30 to include a plurality of sets of transport rollers 33,34 with one set of the transport rollers 34 being positioned directly adjacent a bill entry slot opening 45 in the cash box that receives an incoming bill 28. These entry slot feeder rollers are labeled 34 in FIG. 1 and may take the form of pinch rollers having surfaces that are arranged to pinch the incoming bill to provide at least one small lateral bend in the bill. Such bending provides some rigidity to the bill which helps prevent it from straying off course as it is passed into a bill entry slot in the cash box. This has the advantage of reducing the width requirements of the bill entry slot and reducing the possibility of misfeeds and jams.

Figures 2, 3:
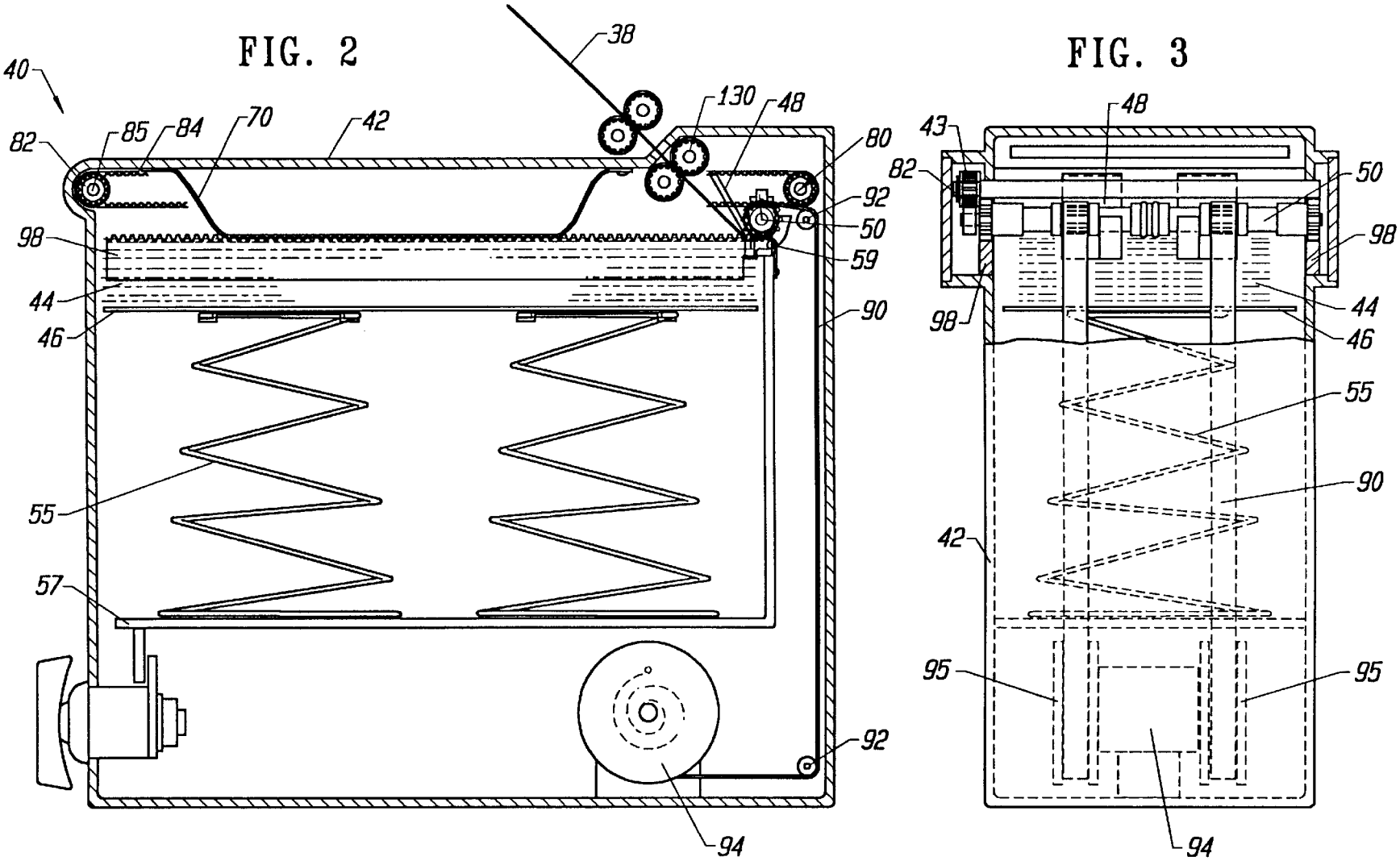
FIG. 2 is a diagrammatic cross sectional side view of the cash box component of the bill acceptor shown in FIG. 1.
FIG. 3 is a diagrammatic cross sectional end view of the cash box shown in FIG. 2.

Referring to FIGS. 2 and 3, a representative cash box 40 in accordance with one aspect of the present invention will be described in more detail. The cash box 40 includes a housing 42 arranged to receive a stack of bills 44 that are supported by, a stacking plate 46. A pair of pinch rollers 130 direct an incoming bill towards a gripper 48 that is arranged to catch the leading edge of an incoming bill 28 and hold it in place. A stack roller 50 is arranged to travel longitudinally relative to the stacking plate 46 to "roll" a newly received bill onto a top end of the bill stack 44 (if present) or the stacking plate 46 when an incoming bill is being received. Thus, the gripper 48 holds the leading edge of the incoming bill as it is rolled onto the stack. The gripper also prevents the stack edges from curling up or buckling above the stack roller. That is, it effectively manages the front edge of the bill stack.

A stack positioning mechanism is also provided to insure that the top surface of the bill stack remains in substantially the same plane regardless of the number of bills in the stack. A roller drive mechanism 80 is provided to drive the stack roller back and forth across the top end of the bill stack 46. A pair of belts 90 are looped around the stack roller 50 such that they are rolled onto the stack as the stack roller traverses from a home position (suitable for receiving a new incoming bill) and an extended position (at which point the incoming bill has been rolled onto the stack. The belts 90 are taken up as the stack roller is returned to its home position.

In the embodiment shown in FIGS. 2 and 3, the housing 42 is substantially rectangular in cross section, but includes a pair of side flanges 43 that provide access for the roller drive mechanism 80. The housing also includes a bill entry slot 45 through which incoming bills may be introduced to the cash box and a lockable door that provides access to bill stack for retrieving bills therefrom.

The stack positioning mechanism includes coil springs 55 that are positioned between a shelf 57 and the stacking plate 46. The shelf 57 may be formed in any suitable manner. By way of example, the shelf 57 may be rigidly fixed within the housing 42 or molded as an integral part of the housing 42. Thus, the shelf 57 provides a secure base for supporting the stacking plate 46. As can best be seen from FIG. 2, the coil springs 55 are arranged to bias the stacking plate 46 upward to insure that the top of the stack remains within a rolling plain of the stack roller 50 regardless of the height of the bill stack 44. The stack positioning mechanism also includes a stack stabilizing mechanism 70 which is arranged to bias the top surface of the bill stack in a direction opposite to the directions that the stack is biased by the coil springs 55. This helps prevent the top surface of the bill stack from moving substantially above the roller plane. In the embodiment shown in FIG. 2, the stack stabilizing mechanism 70 takes the form of a leaf spring. Although, as described below, it should be appreciated that a variety of other mechanisms can be used as well.

The roller drive mechanism 80 used to reciprocate the stack roller back and forth to complete each cycle may take a wide variety of forms. By way of example, belts, chains, cables, lead screws, moving racks, or linear drives such as the "scotch yoke" or the "level winding screw" may all be used as the drive mechanism. In the embodiment shown, the drive mechanism takes the form of a belt drive having a pair of gears or pulleys 82 mounted at opposite ends of the housing 42 with a belt 84 extending there between. One of the drive pulleys 82 has a drive shaft 85 that may be coupled to an external drive motor (not shown). With this arrangement, it is not necessary to provide a drive motor on each cash box yet security is maintained. The entire roller drive mechanism 80 is preferably located in one of the side flanges 43 of the housing. One advantage of this structure is that the only part that needs to be open for connection with an external part is the drive shaft 85. Of course, a wide variety of alternative roller drive mechanisms may be provided as well. In some embodiments, it may be desirable to provide a drive motor at a location that is internal to the cash box, although this would often increase the costs (especially in situations where two or more dedicated cash boxes are provided for each bill acceptor), by requiring the addition of several parts.

The belts 90 may serve several functions. To begin with, they hold a freshly rolled out bill in place as the roller retracts to prevent the roller from catching the bill which could cause the bills to be pushed to a side or bunched up on one end of the stacking plate 46 thereby causing jamming. The belts also help stabilize the stack during the rolling out process. As seen in FIGS. 2 and 3, a first end of each of the belts 90 is attached to the shelf 57 at a fixed point. Each belt 90 is then looped around the stack roller 50 and associated pulleys 92 on its way to an associated spring loaded reel 95 that may be mounted in any suitable place on the housing. The spring loaded reels 95 may be supported by a common mount 94, with each take up reel being arranged to receive an associated one of the belts 90. With this arrangement, the belt is laid across the incoming bill as it is rolled onto the bill stack 44. This prevents the stack roller 50 from catching on the incoming bill 38 as the stack roller is returned to its home position. The spring loaded reel 90 is arranged to insure that the belts 90 remain tensioned at all times. By providing a pair of spaced apart belts, the cash box is particularly well suited for receiving bills having significantly different widths. This has several advantages. In countries that utilize bills of different widths, it permits a common cash box to be used to receive bills of varying widths at the same time. It also permits a single cash box design to be used in a number of different jurisdictions, which has all of the manufacturing advantages of international standardization. In alternative embodiments, a single belt may be used or the belts may be eliminated entirely. It is noted that in single belt embodiments, it is often advantageous to provide a center mounted belt.

In an alternative embodiment, one or both of the belts 90 (or the single belt in a one belt system) may take the form of a timing belt. The timing belt is arranged to insure that the stack roller 50 moves across the bill stack with a rolling motion as opposed to a sliding motion. In this embodiment, the racks 95 and pinions 100 may be eliminated. Alternatively, a flexible rack may be employed to drive the stack roller.

Referring next to FIG. 4A, one suitable embodiment of the stack roller will be described. As seen therein, the stack roller 50 includes a pair of pinions 100 arranged to engage corresponding racks 95. A pair of belt guides 102, a roller guide 104 and a drive shaft 106. This roller structure is well suited for use in the embodiment shown in FIGS. 2 and 3. Specifically, the pinions 100 engage the rack 95 to provide suitable timing. More particularly, the pitch diameter of the pinions 100 is arranged to be exactly the same as the roller's rolling surface diameter. This insures that the linear progression of the roller will be at the same rate as a nonslipping stack roller would roll. This, together with the belts 90, the rack and pinion design help prevent the bills from "walking" or "creeping". As will be appreciated by those skilled in the art, bill creeping leads to bunching and bunching increases the risks of jamming the bill stacker.

In this embodiment, the rolling surface of the rollers is provided by roller guide 104. In the embodiment shown, the roller guide 104 has a pair of rubber O-rings 108 which provide the rolling surface diameter for the roller 50. The rubber O-rings tend to grip better than plastic parts and/or metal parts which tend to be used in much of the remainder of the roller. However, it should be appreciated the O-rings are not necessary and that other arrangements can be used to accomplish the same purpose. The intended purpose of the O-rings or any other high coefficient of friction surface is to minimize slippage of the bill as it is rolled into position. High coefficient of friction material may include certain polymers or mechanically roughened surfaces.

The belt guides 102 are arranged to guide the belt 90 as it is laid across the bill stack 44. Thus, they insure that the belts 90 do not wander back and forth across the bill stack. The belt guides 102 each have a pair of outer rims 105 with a groove 107 located therebetween. The associated belt is arranged to pass over the groove 107 and is contained by the rims 105. In the embodiment shown, two belts are provided. However, single belt and multiple belt configurations are also feasible Referring next to FIG. 4B, an alternative embodiment of the stack roller 50(*a*) will be described. This roller is adapted for use with a timing belt system in which the flat belts used with the roller of FIG. 4A are replaced with timing belts. In the embodiment shown, the grooves 107 include teeth 108. The roller grove teeth are sized to mesh with teeth from the timing belt. It is noted that in this embodiment, the pinions used in the previously described embodiment are not required. The reason is that both the timing belts and the rack and pinion structure provide a roller controlling timing function. Therefore, the use of both systems would be redundant increase the probability of binding during use. Of course, single timing belt and multiple timing belt configurations may be used in alternative embodiments. In systems that use two or more belts, not all of the belts need to be timing belts, although it is often advantageous to use two timing belts located on opposite ends of the roller to help prevent either end from slipping.

Referring next to FIGS. 5A and 5B, one embodiment of the gripper 48 will be described in more detail. As seen therein, the gripper 48 is pivotable at a pivot point 121 and has a roller catch 122 and a bill stack engaging foot 124. The roller catch and the engaging foot are coupled together to more or less form a J-shaped part. As best seen in FIG. 5B, the gripper foot 124 is substantially wider than the catch 122. As will be described in more detail below, when the roller is in an extended position, the belts 90 are arranged to pass to the side of the roller catch 122 of their associated gripper but over the foot 124 thereof to hold the gripper against the top of the bill stack 44.

Referring next to FIGS. 2 and 6–9, the operation of the described bill stacker will be explained in more detail. When the bill stacker is in a home position that is prepared for the reception of a new bill, the stack roller 50 is in a fully retracted position (which is shown to the right in FIG. 2). In this retracted position, the stack roller 50 abuts against the catches 122 of grippers 48 causing the grippers to pivot in a clockwise direction (relative to FIG. 2) so that the gripper feet 124 are lifted off of the bill stack to a position that is above the path by which an incoming bill approaches the bill stack.

Figure 6:
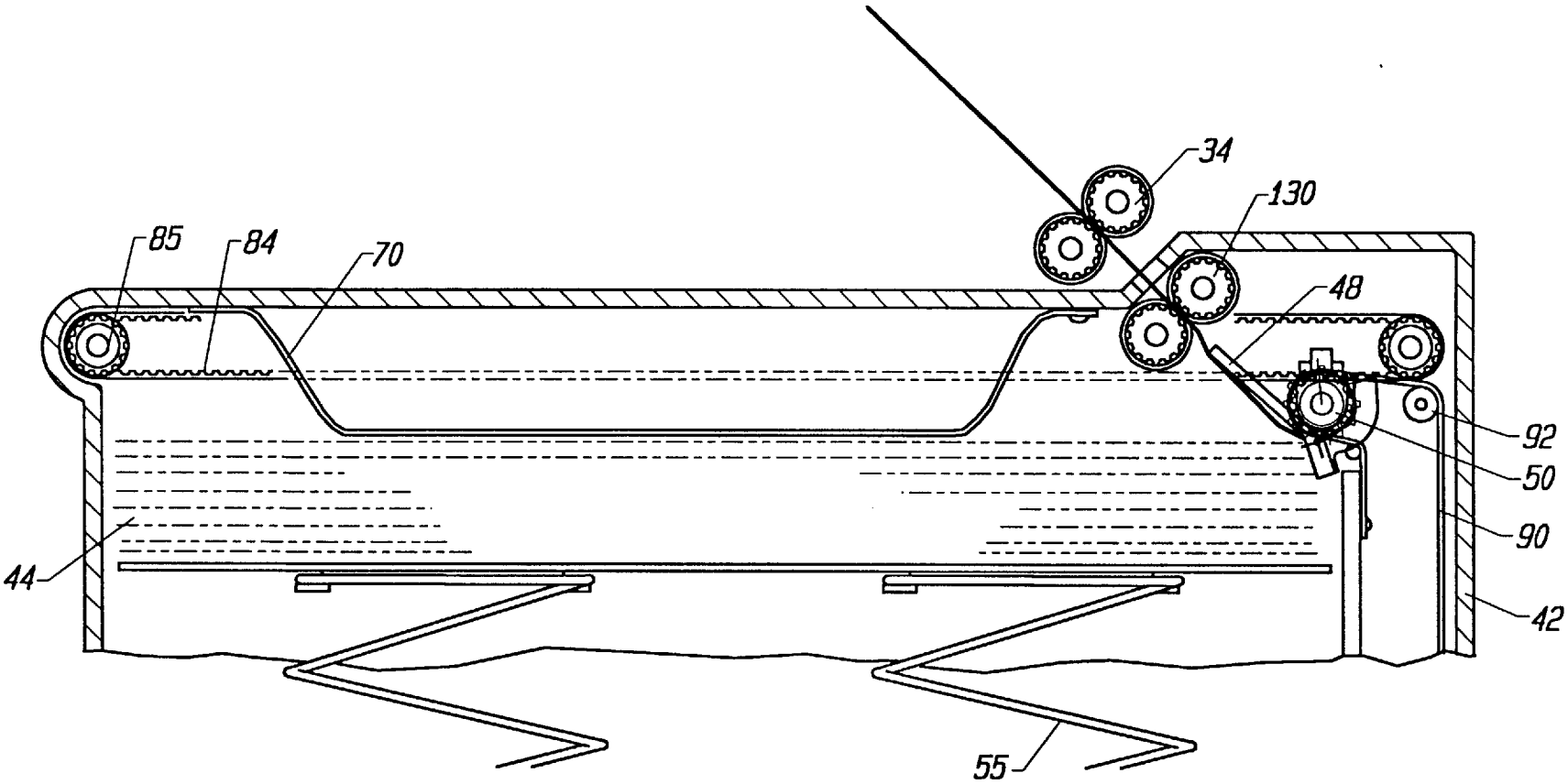
FIGS. 6–9 are a series of diagrammatic cross sectional side views of an upper portion of the cash box of FIG. 2 illustrating the progression of various components as a new bill is rolled onto a bill stack.
Figure 7:
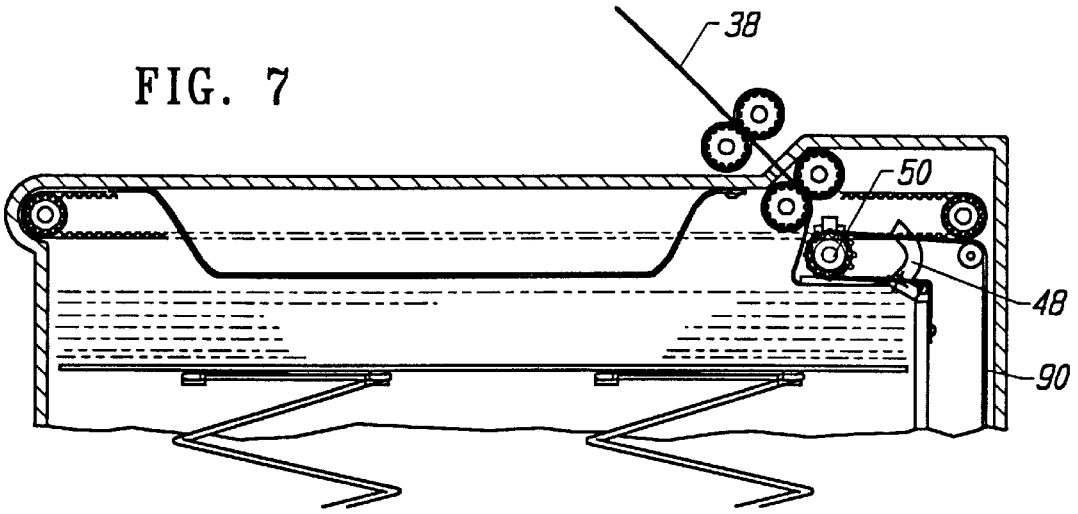

The coils springs 55 and the stack stabilizing mechanism 70 cooperate to maintain the top of the stack at a position that is substantially in the same plane as the stack roller 50. The feed mechanism's rollers 34 and the bill entry slot guarding pinch rollers 130 direct an incoming bill to a position that approaches the top of the stack at a position under the raised grippers 48. When the bill arrives at the stack, the roller drive mechanism 80 is actuated and begins to drive the stack roller 50 across the top of the incoming bill. Referring next to FIG. 6, when the roller first begins to move, it presses against the gripper feet 124 and begins to pivot the grippers 48 towards a position that engages the incoming bill 38. As the stack roller 50 travels further, it fully pivots the grippers 48 to a position that presses the leading end of the incoming bill against the top of the bill stack 44 as is illustrated in FIG. 7. As the stack roller 50 progresses, it effectively "rolls" the incoming bill 38 onto the top of the bill stack 44 and rolls the belts 90 onto the top surface of the bill stack. As indicated above, the grippers 48 are positioned such that their feet 124 will be positioned directly under the belts. Thus, once the roller has cleared the grippers, the belts 90 hold the grippers in place. The belts 90 also hold the bill stack 44 in place. In beltless versions, the grippers are spring loaded against the bill stack and are held in place during the bill roll out operation by a latch mechanism as will be described in more detail below with reference to FIGS. 13 and 14.

Figure 8:
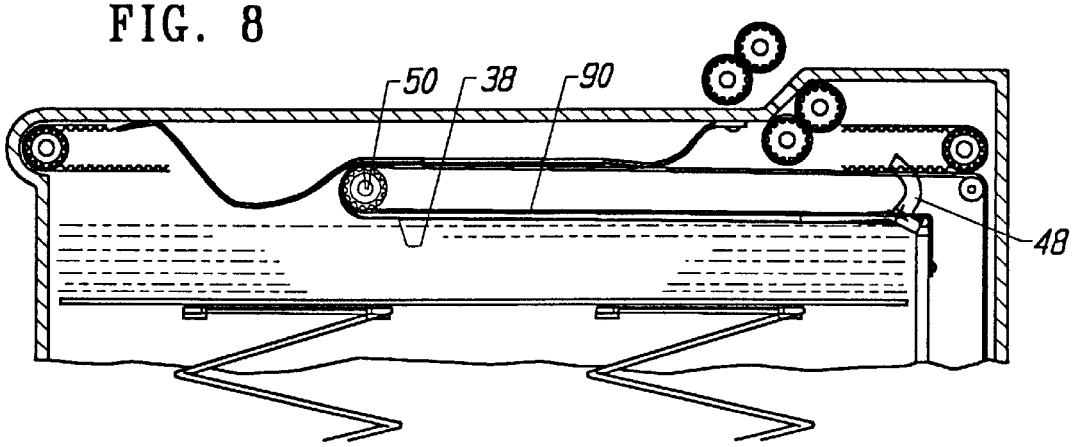

In the embodiment shown, the stack stabilizing mechanism takes the form of one or more longitudinally arranged leaf springs. As seen in FIG. 8, the stack roller 50 brushes the leaf springs out of the way as it travels. In some embodiments, the stack stabilizing mechanism is arranged to reengage the top surface of the stack as the stack roller passes to better hold the top surface of the stack in place.

Figure 9:
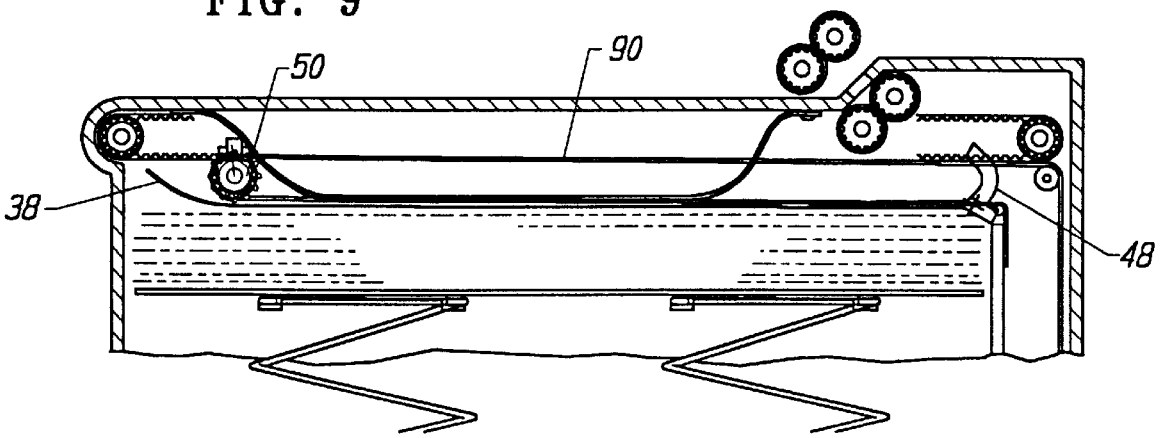

When the roller 90 has been rolled out, as illustrated in FIG. 9, the stack roller's job is done. The roller may then be returned to the home position. It is not necessary to stroke the stack roller past the far end of the incoming bill, or even to the very end of the bill stack since the trailing end of the bill will effectively flop into place when the roller nears the end of its stroke. However in many embodiments it will be desirable to permit the stack roller to stroke the entire length of the bill stack to provide extra insurance against the risks of bill jamming at that end.

In some embodiments, it may be desirable to provide a sensor (not shown) that detects the length of the incoming bill (such as by detecting its leading and trailing edges). In one such embodiment, the drive mechanism control is arranged to stop the stack roller stroke at a position before the roller reaches the trailing end of the incoming bill. This helps prevent the roller from catching the trailing edge of the bill as in returns to the home position, which could lead to bunching, which increases the chances of jamming. This type of arrangement may be particularly useful in embodiments which don't utilize the described belts 90 and/or are intended for use in applications in which the cash box may receive bills of varying lengths, since the risk of having the stack roller catch an end of a bill is greater in such applications.

Referring next to FIG. 10, an alternative embodiment of the gripper 48*a* will be described. In this embodiment, the side of the gripper foot 124*a* that engages the bill stack 44 is serrated. The teeth 126 that form the serration engage the bill stack and help prevent the bill stack from slipping during use. Also, it should be appreciated that while the stack positioning mechanism and the stack stabilizing mechanisms are intended to hold the top surface of the bill stack in more or less the same plane, as a practical matter, there will often be variations. As will be appreciated by those skilled in the art, the coil springs and leaf spring are not inherently linear in nature and some floating will typically occur at the top of the stack as the bill stack grows. The teeth 126 on gripper 48 can help catch the top of the stack in such situations. Of course, the top of the stack may float for a number of other reasons as well. By way of example, some floating may result from manufacturing variations and tolerances. Wear and tear of the components may have a similar effect. Of course, the problem is amplified in embodiments which do not include a stack stabilizing mechanism.

It should be appreciated that a wide variety of alternative stack stabilizing mechanism may be use as well. By way of example, a plurality of rows of brushes 151 may be used to stabilize the stack as illustrated in FIG. 11. In this embodiment, the brushes are simply pushed to the side by the roller as it traverses. After the roller passes, the brushes spring back into place to support the stack. Alternatively, one or more rows of pivoting toggle cams 153 may be provided as illustrated in FIG. 12. Like the brushes, the toggle cams are pushed out of the way by the roller as it passes and spring back to the stack engaging position after the roller has passed. The toggle cams are typically biased so that they spring back to a position that engages the bill stack. Preferably the toggle cams are staggered or spaced far enough apart such that they cannot interfere with one another even if they are inadvertently swung in opposite directions. This reduces the possibility of jamming. When the cams are arranged in linear rows, on the order of three to five toggle cams per row has been found to work well. In some preferred embodiments, the brushes and cams are combined into a stack stabilizing mechanism having multiple rows of stabilizing mechanisms. By way of example, a center row of pivoting cams together with a pair of rows of brushes located on opposite sides of the toggle cam row has been found to work well. Of course, the number of stack stabilizing rows as well as the nature of the stack stabilizing mechanisms used may be widely varied to meet the needs of a particular system. Still another embodiment may incorporate a series of staggered overlapping leaf springs. Of course, the various described stack stabilizing mechanisms may be used either separately or in combination.

Figure 15:
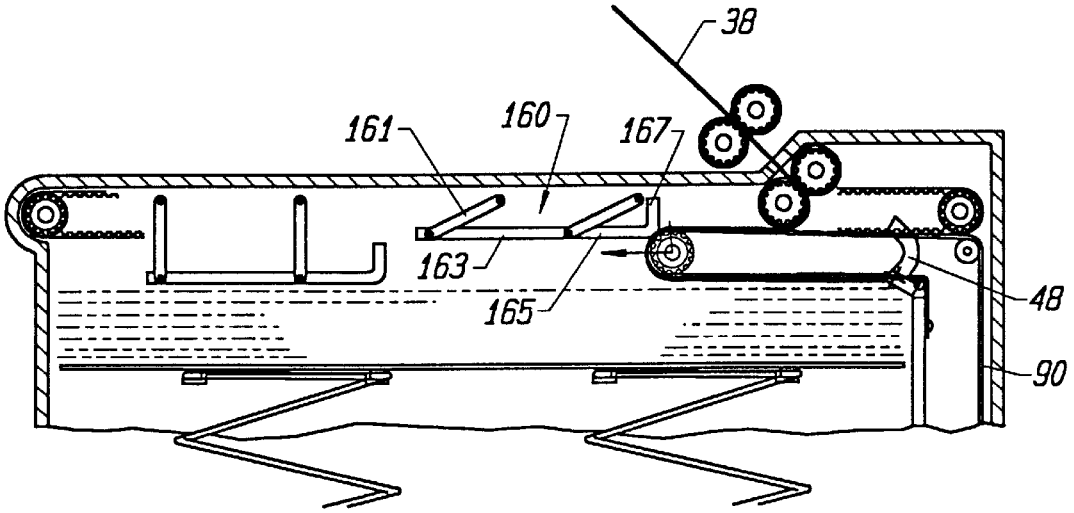
FIG. 15 is a diagrammatic side view of the upper portion of a cash box incorporating a toggling link bar based stack stabilizing mechanism in accordance with another alternative embodiment of the present invention.

Referring next to FIG. 15, yet another alternative stack stabilizing mechanism will be described. This embodiment contemplates the use of one or more toggling link bar assemblies. Each toggling link bar assembly 160 includes a pair of toggle arms 161 and a stabilizing bar 163. The toggle arms 161 may take the form of toggle cams similar to those described above with reference to FIG. 12. One end of each of the toggle arms 161 is pivotally connected to the stabilizing bar and the other end is pivotally connected to the housing 42. The stabilizing bar may simply extend between the toggle arms, or it may include an extended leg 165, which extends its contact length along the bill stack. The leg 165 will typically include a lip 167 that engages the roller to insure that the roller passes under the toggling link bar assembly 160 without catching the stabilizing bar. When the leg 165 is not present, there is typically no need for such a lip since the end toggle arm 161 would effectively perform the same function. In alternative embodiments, a leg 165 may be provided on each end of the stabilizing bar 163. In the embodiment shown, a pair of longitudinally aligned toggle link bar assemblies are arranged in a row, with the stabilizing bars being aligned longitudinally with the stacked bills. In alternative embodiments, staggered toggling link bar assemblies, multiple rows of toggling link bar assemblies and/or the toggle link bar assemblies integrated with other mechanisms such as those described above may be used. In still other embodiments, the stabilizing bars may be aligned perpendicularly to the bill stack's longitudinal access. In the embodiment shown, a pair of toggle arms are provided for each stabilizing bar. However, the number of toggle arms used to support each stabilizing bar may be varied and indeed the stabilizing bar may take the form of a toggle sled or a two dimensional matrix of bars that is supported by the toggle arms.

Figure 13:
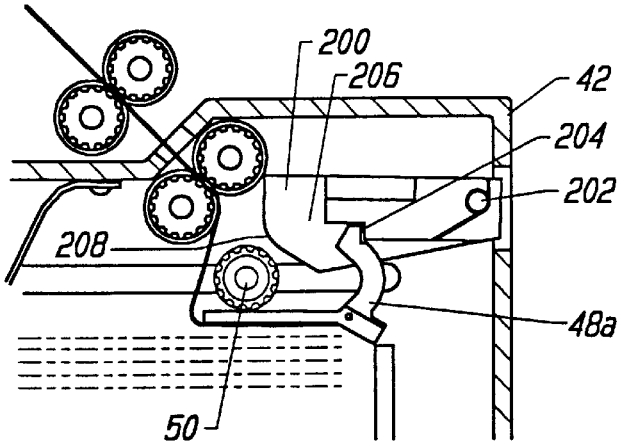
FIG. 13 is a diagrammatic side view of a gripper latching arrangement suitable for latching an alternative embodiment of the gripper in a bill holding position when the roller is away from its home position.
Figure 14:
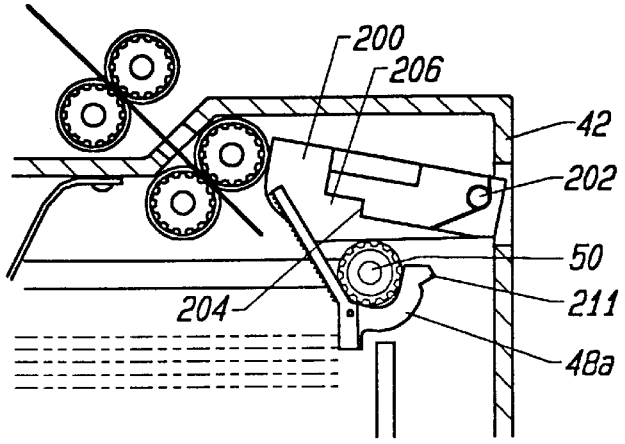
FIG. 14 is a diagrammatic side view of the gripper latching arrangement illustrated in FIG. 13 with the gripper in its home position.

Referring next to FIGS. 13 and 14, a latching arrangement for the gripper 48*a* that is well suited for use in beltless versions of the bill stacker will be described in more detail. Initially, it should be appreciated that in the belted embodiment of the bill stacker described above, the gripper 48 was held in place during the stroking of the stack roller by the belts 90. Accordingly, in beltless versions, an alternative mechanism must be provided to hold the grippers in place during stroking. In the embodiment shown, a latch mechanism 200 is pivotably mounted to the housing 42 by pivot 202. The latch mechanism includes a catch 204 and a cam finger 206 having a camming surface 208. The catch 204 is arranged to engage a latch 211 that extends from the foot 124 of gripper 48*a* when the gripper 48*a* is in the actuated position as illustrated in FIG. 13. When the stack roller 50 is ingressed towards its home position, the stack roller engages the camming surface 208 of cam finger 206, thereby pivoting the latch upward to the home position that is illustrated in FIG. 14. This releases the latch 211 from the catch 204 thereby allowing the stack roller 50 to pivot the gripper 48*a* to its home position as seen in FIG. 14.

When the stack roller is egressed to roll out a new bill, the stack roller 50 rotates the gripper 48 into the extended position shown in FIG. 13. The latch mechanism is both spring and gravity biased towards the latching position where the catch 204 engages latch 211 on gripper 48*a*. Therefore, after the stack roller egresses clear of the gripper 48, the latch mechanism 200 holds the gripper 200 in place on the top of the bill stack causing the gripper to control the leading edge of the bill stack. In some embodiments, the gripping surface that engages the bill stack is serrated to improve its grip. In other embodiments, a high friction surface is employed, such as an exposed grit or sticky polymer.

The roll stacking method described herein is inherently more reliable than plunge stacking since it is less susceptible to slippage and is not dependent upon partial grips like ram stackers. It is also more forgiving for bill variables such as tears, moisture content and size fluctuations. Although only a few embodiments of the present invention have been described in detail, it should be understood that the present invention may be embodied in many other specific forms without departing from the spirit or scope of the invention. By way of example, in embodiments that do not include dedicated grippers, the stack roller itself may be used to catch the leading edge of the incoming bill.

As will be appreciated by those skilled in the art, the stacking principles and mechanisms described herein can be used in conjunction with a wide variety of bill validators, bill acceptors and cash boxes. The bill stacker has been described in conjunction with a bill acceptor suitable for use in the gaming industry, which has security requirements that are considerably more stringent than most bill acceptor applications. Of course, the described stacking mechanism can be used in conjunction with stack receptacles that are considerably less secure than the described cash box.

In the discussion above, the stack positioning mechanism has been described as a stack biasing mechanism that biases the stack in a given direction. In alternative embodiments, other suitable mechanisms may be used in conjunction with or in place of the described biasing mechanism. By way of example, simple friction devices and linear driven platforms may be used as the stack positioning mechanism. In the described biasing mechanism, coil springs were used. However, it should be appreciated that a wide variety of other biasing mechanisms may be used. By way of example, in addition to coil springs, torsion springs, foam blocks, constant torque springs, constant tension springs, simple friction devices and linear driven platforms may be used as the stack biasing mechanism. Similarly, several stack stabilizing mechanisms have been described. In alternative embodiments, a wide variety of other stabilizing mechanisms may be used as well. Further, rotating swinging or linearly actuating stack stabilizing elements may supplement the above mentioned stabilizers in the bill feed area. In some embodiments, the stack stabilizing and stack positioning mechanisms may be combined into one mechanism or the stack positioning mechanism may be eliminated altogether. Other described components can also be readily varied to accomplish the described roll stacking methods described herein. Therefore, the present examples are to be considered as illustrative and not restrictive, and the invention is not to be limited to the details given herein, but may be modified within the scope of the appended claims.

What is claimed is:

1. A bill stacker comprising:

a housing arranged to receive a stack of bills;

a stacking surface arranged to support the stack of bills, wherein a bottom end of the stack rests on the stacking surface;

a stack roller arranged to travel across the stacking surface to roll a newly received bill onto a top end of the bill stack, wherein when no stack of bills is present on the stacking surface, the newly received bill is rolled onto the stacking surface to initiate a bill stack; and a stack positioning mechanism arranged to ensure that the top surface of the bill stack remains in substantially the same plane regardless of the number of bills in the stack and the stack roller is arranged to travel back and forth within a roller plane that is substantially parallel to the stacking surface, wherein the stacking surface is a surface of a stacking plate and the stack positioning mechanism includes a biasing mechanism that biases the stacking plate towards the roller plane and a stack stabilizing mechanism that biases the top surface of the bill stack in a direction opposite to the direction that the biasing mechanism biases the stacking plate to help prevent the top surface of the bill stack from moving into the roller plane, the stack stabilizing mechanism being independent from the stack roller such that the stack stabilizing mechanism is brushed away from the bill stack by the stack roller and is not rolled onto the stack by the stack roller as the stack roller travels across the stacking surface.

2. A bill stacker as recited in claim 1 wherein the roller further includes at least one region with a high coefficient of friction that constitutes a rolling surface that engages the bill while the bill is being rolled out.

3. A bill stacker as recited in claim 1 wherein the biasing mechanism is arranged between the housing and a second surface of the stacking plate and the stack stabilizing mechanism is supported by the housing.

4. A bill stacker as recited in claim 1 wherein the stack stabilizing mechanism includes at least one leaf spring.

5. A bill stacker as recited in claim 1 wherein the stack stabilizing mechanism includes at least one brush.

6. A bill stacker as recited in claim 1 wherein the stack stabilizing mechanism includes at least one toggle cam.

7. A bill stacker as recited in claim 1 further comprising a belt that loops over the stack roller and is rolled out across a top surface of the newly received bill as the stack roller rolls the newly received bill onto the bill stack such that when the stack roller is egressed to an extended position wherein the newly received bill is substantially fully rolled onto the bill stack, the belt lies across the top surface of the newly received bill which then becomes the top surface of the bill stack, whereby the belt helps prevent the stack roller from catching the bill stack when the stack roller is returned to a home position that is suitable for receiving a next new bill.

8. A bill stacker as recited in claim 7 further comprising a second belt that loops over the stack roller and is rolled out across the top surface of the newly received bill in the same manner as the first described belt, wherein the stacking surface has a longitudinal centerline and the first and second belts are located on opposite sides of the longitudinal centerline of the stacking surface.

9. A bill stacker as recited in claim 8 further comprising a spring loaded reel positioned within the housing for spooling the first belt.

10. A bill stacker as recited in claim 7 wherein the belt is a timing belt and the stack roller includes a gear that meshes with the timing belt for ensuring that the stack roller does not slip substantially as it passes back and forth across the bill stack.

11. A bill stacker as recited in claim 7 further comprising a tensioning mechanism positioned within the housing for spooling and tensioning the belt.

12. A bill stacker as recited in claim 1 wherein the stacking surface is substantially horizontally oriented.

13. A bill stacker as recited in claim 1 wherein the stacking surface is substantially vertically oriented.

14. A bill stacker as recited in claim 1 wherein the stack stabilizing mechanism includes a row of toggle cams and two rows of brushes, the brush rows being located on opposite sides of the toggle cam row.

15. A bill stacker as recited in claim 1 wherein the housing is a cash box that has a bill inlet sized suitably for receiving a bill and a door for permitting access to the bill stack, the bill stacker further comprising a lock for locking the door.

16. A bill stacker as recited in claim 15 further comprising a pair of facing intake rollers positioned adjacent the bill inlet for guiding the newly received bill towards the stack roller, wherein the intake rollers are positioned to help prevent a stacked bill from being retrieved through the bill inlet.

17. A bill stacker as recited in claim 15 wherein other than the door and the bill inlet the cash box does not have any external openings that permit sufficient access to the bill stack to permit a bill to be taken from the bill stack.

18. A bill stacker as recited in claim 1 wherein the stack stabilizing mechanism includes a toggle link bar assembly that includes a stabilizing bar and first and second toggle arms each having respective first and second ends, the first ends of the toggle arms being pivotally coupled to the housing and the second ends of the toggle arms being pivotally couple to the stabilizing bar such that the stabilizing bar is arranged to engage the bill stack.

19. A bill acceptor comprising:

a bill validator for validating bills introduced to the bill acceptor;

a cash box comprising a bill stacker as recited in claim 1;

a feed mechanism for transporting bills accepted by the bill validator to the cash box for storage.

20. A bill acceptor as recited in claim 19 wherein the bill validator only gives credit for a validated bill after the bill has been rolled onto the bill stack.

21. A slot machine having a built in bill acceptor as recited in claim 19.

22. A bill stacker comprising:

a housing arranged to receive a stack of bills;

a stacking surface arranged to support the stack of bills, wherein a bottom end of the stack rests on the stacking surface;

a stack roller arranged to travel across the stacking surface to roll a newly received bill onto a top end of the bill stack, wherein when no stack of bills is present on the stacking surface, the newly received bill is rolled onto the stacking surface to initiate a bill stack; and a drive train that controls the movements of the stack roller back and forth across the bill stack, wherein the drive train includes a toothed mechanism for ensuring that the stack roller does not slip substantially as it passes back and forth across the bill stack, wherein the drive train includes a rack mounted on the housing and the stack roller includes a pinion that engages the rack, wherein the pinion is arranged to have a pitch diameter that is the same as a diameter of a rolling surface of the stack roller to insure that the stack roller does not slip substantially as is passes back and forth across the bill stack.

23. A bill stacker as recited in claim 22 wherein the drive train further comprises a second rack and the stack roller further includes a second pinion, the first and second pinions being positioned on opposite ends of the stack roller such that the stack roller is supported on both ends.

24. A bill stacker as recited in claim 22 wherein the drive train includes a drive shaft that extends outside of the housing for engaging an external driver and a drive belt that extends between the drive shaft and the stack roller for driving the stack roller.

25. A bill stacker comprising:

housing arranged to receive a stack of bills;

a stacking surface arranged to support the stack of bills, wherein a bottom end of the stack rests on the stacking surface;

a stack roller arranged to travel across the stacking surface to roll a newly received bill onto a top end of the bill stack, wherein when no stack of bills is present on the stacking surface, the newly received bill is rolled onto the stacking surface to initiate a bill stack;

a stack positioning mechanism arranged to ensure that the top surface of the bill stack remains in substantially the same plane regardless of the number of bills in the stack;

a gripper, independent of the stack positioning mechanism, for holding a first end, and only the first end, of the newly received bill in place as the stack roller rolls out the newly received bill.

26. A bill stacker as recited in claim 25 wherein the gripper includes a textured surface that is arranged to apply a positive mechanical grip to the first end of the newly received bill.

27. A bill stacker comprising:

a housing arranged to receive a stack of bills;

a stacking surface arranged to support the stack of bills, wherein a bottom end of the stack rests on the stacking surface;

a stack roller arranged to travel across the stacking surface to roll a newly received bill onto a top end of the bill stack, wherein when no stack of bills is present on the stacking surface, the newly received bill is rolled onto the stacking surface to initiate a bill stack; and a gripper for holding a first end of the newly received bill in place as the stack roller rolls out the newly received bill, wherein gripper takes the form of a cam mechanism that is moveable between a release position that is free from the bill stack and permits the first end of the newly received bill to be positioned on top of the stack and a hold position wherein the gripper holds the first end of the newly received bill in place, wherein the stack roller is arranged to toggle the gripper between the release and hold position.

28. A bill stacker as recited in claim 27 further comprising a belt that loops over the stack roller and is rolled out across a top surface of the newly received bill as the stack roller rolls the newly received bill onto the bill stack such that when the stack roller is egressed to an extended position wherein the newly received bill is substantially fully rolled onto the bill stack, the belt lies across the top surface of the newly received bill which then becomes the top surface of the bill stack, wherein the belt holds the gripper in the hold position when the stack roller is in the extended position.

29. A bill stacker as recited in claim 27 wherein the gripper is pivotably coupled to the housing.

30. A bill stacker as recited in claim 27 further comprising a gripper latch mechanism adapted to hold the gripper in the hold position when the stack roller is in the extended position.

31. A bill stacker as recited in claim 30 wherein the latch mechanism includes a cam surface that is engaged by the stack roller as the stack roller returns to a home position that is suitable for receiving a new bill such that movement of the stack roller across the cam surface causes the latch mechanism to release the gripper from the hold position.

32. A bill stacking cash box adapted for use with a bill validator, the bill stacking cash box comprising:

a housing arranged to receive a stack of bills, the housing including a bill inlet sized suitably for receiving a bill and a door for permitting access to the bill stack;

a lock for locking the door;

a stacking plate received within the housing, the stacking plate being arranged to support the stack of bills on a first surface of the stacking plate, wherein when a stack of bills is supported by the stacking plate, a bottom end of the stack rests on the stacking plate;

a stack roller arranged to travel longitudinally relative the first surface of the stacking plate to roll a newly received bill onto a top end of the bill stack, wherein when no stack of bills present on the stacking plate, the newly received bill is rolled onto the stacking plate to initiate a bill stack;

a stack positioning mechanism arranged to insure that the top surface of the bill stack remains in substantially the same plane regardless of the number of bills in the stack and the stack roller is arranged to travel back and forth within a roller plane that is substantially parallel to the stacking plate;

a gripper supported by the housing for holding a first end, and only the first end, of the newly received bill in place as the stack roller rolls out the newly received bill; and a belt independent of the gripper that loops over the stack roller and is rolled out across a top surface of the newly received bill as the stack roller rolls the newly received bill onto the bill stack such that when the stack roller is egressed to an extended position wherein the newly received bill sis substantially fully rolled onto the bill stack, the belt lies across the top surface of the newly received bill which then becomes the top surface of the bill stack, whereby the belt helps prevent the stack roller from catching the bill stack when the stack roller is returned to a home position that is suitable for receiving a next new bill.

33. A bill stacking cash box as recited in claim 32 further comprising a drive train that controls the movements of the stack roller back and forth across the bill stack, the drive train including a rack mounted on the housing and wherein the stack roller includes a pinion that engages the rack, wherein the pinion is arranged to have a pitch diameter is the same as a diameter of a rolling surface of the stack roller to ensure that the stack roller does not slip substantially as is passes back and forth across the bill stack.

34. A bill stacking cash box as recited in claim 32 wherein the roller further includes at least one high coefficient of friction surface that constitutes a rolling surface that engages the bill while the bill is being rolled out.

35. A bill stacking cash box as recited in claim 33 wherein the stack roller further includes a second pinion and the drive train further includes:

a second rack arranged to engage the second pinion, the first and second pinions being positioned on opposite ends of the stack roller such that the stack roller is supported on both ends;

a drive shaft that extends outside of the housing for engaging an external driver and;

a drive belt that extends between the drive shaft and the stack roller for driving the stack roller.

36. A bill stacking cash box as recited in claim 32 further comprising:

a second belt that loops over the stack roller and is rolled out across the top surface of the newly received bill in the same manner as the first described belt, wherein the stacking plate has a longitudinal centerline and the first and second belts are located on opposite sides of the longitudinal centerline of the stacking plate;

a spring loaded reel positioned within the housing for spooling the belt.

37. A bill stacking cash box as recited in claim 32 wherein the belt is a timing belt and the stack roller includes a gear that meshes with the timing belt for insuring that the stack roller does not slip substantially as it passes back and forth across the bill stack.

38. A bill stacking cash box as recited in claim 32 further comprising a pair of facing intake rollers positioned adjacent the bill inlet for guiding the newly received bill towards the stack roller, wherein:

the intake rollers are positioned to help prevent a stacked bill from being retrieved through the bill inlet;

other than the door and the bill inlet the cash box does not have any external openings that are as large as the bill inlet or that permit sufficient access to the bill stack to permit a bill to be taken from the bill stack.

39. A bill acceptor comprising:

a bill validator for validating bills introduced to the bill acceptor;

a bill stacking cash box as recited in claim 32, and a feed mechanism for transporting bills accepted by the bill validator to the cash box for storage; and wherein the bill validator only gives credit for a validated bill after the bill has been rolled onto the bill stack.

40. A bill stacking cash box as recited in claim 32 wherein gripper takes the form of a cam mechanism that is pivotably coupled to the housing and moveable between a release position that is free from the bill stack and permits the first end of the newly received bill to be positioned on top of the stack and a hold position wherein the gripper holds the first end of the newly received bill in place, wherein the stack roller is arranged to toggle the gripper between the release and hold positions and the belt holds the gripper in the hold position when the stack roller is in the extended position.

41. A bill stacking cash box as recited in claim 32 wherein the positioning mechanism includes a first spring that biases the stacking plate towards the roller plane and a stack stabilizing mechanism that biases the top surface of the bill stack in a direction opposite to the direction that the first spring biases the stacking plate to help prevent the top surface of the bill stack from moving into the roller plane.

42. A method of stacking bills in a cash box comprising the steps of:

receiving a bill to be stacked and feeding a first end of the received bill to a stacking location on top of a stacking surface if no bill stack previously exists or on top of a bill stack supported by the stacking surface when the bill stack previously exists;

rolling the bill out on top of one of the bill stack or the stacking surface using a stack roller; and holding the bill stack in substantially the same plane regardless of the number of bills in the stack using a stack stabilizing mechanism that is brushed aside by the stack roller as the bill is rolled out.

43. A method of stacking bills as recited in claim 42 further comprising the step of gripping the first end of the received bill at the stacking location, wherein the bill is rolled out while gripping the first end of the received bill.

44. A method of stacking bills as recited in claim 42 wherein the rolling step is accomplished with a stack roller that translates longitudinally across the bill stack or stacking surface.

* * * * *